US006497059B1

(12) United States Patent
Downer, Jr.

(10) Patent No.: US 6,497,059 B1
(45) Date of Patent: Dec. 24, 2002

(54) ENERGY CONSERVATION SYSTEM FOR EARTH-MOVING LOADING MACHINES

(76) Inventor: Edwin E. Downer, Jr., 5204 Tamerlane Rd., Louisville, KY (US) 40207

( * ) Notice: Subject to any disclaimer, the term of this patent is extended or adjusted under 35 U.S.C. 154(b) by 0 days.

(21) Appl. No.: 09/937,760

(22) PCT Filed: Mar. 30, 2000

(86) PCT No.: PCT/US00/08407

§ 371 (c)(1),
(2), (4) Date: Sep. 27, 2001

(87) PCT Pub. No.: WO00/60177

PCT Pub. Date: Oct. 12, 2000

Related U.S. Application Data

(60) Provisional application No. 60/127,917, filed on Apr. 6, 1999.

(51) Int. Cl.[7] ..... E02F 3/00

(52) U.S. Cl. ..... 37/342; 172/828

(58) Field of Search ..... 37/348, 382, 442, 37/902; 172/816, 828, 830, 812, 813; 60/413, 415, 494, 477; 414/685, 697

(56) References Cited

U.S. PATENT DOCUMENTS

| | | | | |
|---|---|---|---|---|
| 1,504,427 | A | | 8/1924 | Butler |
| 3,574,387 | A | * | 4/1971 | Hahn |
| 3,721,416 | A | | 3/1973 | Goudreau |
| 3,985,384 | A | * | 10/1976 | Hahn |
| 4,062,136 | A | | 12/1977 | Steiger |
| 4,229,136 | A | | 10/1980 | Panissidi |
| 4,300,198 | A | | 11/1981 | Davini |
| 4,421,450 | A | | 12/1983 | Kouno |
| 4,590,763 | A | * | 5/1986 | Augoyard et al. |
| 4,592,697 | A | | 6/1986 | Tuda et al. |
| 4,643,634 | A | | 2/1987 | Duina |
| 4,653,975 | A | | 3/1987 | Akeel |
| 4,686,828 | A | * | 8/1987 | Rosman |
| 4,688,983 | A | | 8/1987 | Lindbom |
| 4,696,197 | A | | 9/1987 | Hannel |
| 4,767,255 | A | | 8/1988 | Mickelson et al. |
| 4,921,225 | A | | 5/1990 | Ludwig |
| 5,116,188 | A | | 5/1992 | Kurohashi et al. |
| 5,269,382 | A | * | 12/1993 | Ottestad |
| 5,314,291 | A | | 5/1994 | Ohashi et al. |
| 5,513,491 | A | * | 5/1996 | Broenner et al. |
| 5,522,221 | A | * | 6/1996 | Kadlicko et al. |
| 6,105,686 | A | * | 8/2000 | Niemi |
| 6,249,994 | B1 | * | 6/2001 | Oertley |
| 6,428,265 | B1 | * | 8/2002 | Gilmore, Jr. |

* cited by examiner

*Primary Examiner*—Victor Batson
(74) *Attorney, Agent, or Firm*—Stites & Harbison, PLLC; David W. Nagle, Jr.

(57) ABSTRACT

An energy conservation system for an earth-moving loading machine is comprised of one or more pressurized gaseous pistons that extend from the front of the frame of a loading machine to the boom assembly. Although this piston does not provide sufficient force to maintain the boom assembly in a raised position, a portion of the weight of the boom assembly and associated payload is always supported by the piston. This energy conservation system thus decreases the hydraulic horsepower needed to raise and lower the boom assembly and payload, or, in the alternative, decreases the cycle time required to raise and lower the boom assembly. The energy conservation system of the present invention into a loading machine also allows for a more controlled lowering of the boom assembly. Finally, the lowering of the boom assembly stores a portion of the potential energy by compressing the gaseous contents of the piston back to essentially the same pressure that existed prior to the raising of the boom assembly, thereby conserving energy.

18 Claims, 5 Drawing Sheets

ENERGY CONSERVATION SYSTEM FOR EARTH-MOVING LOADING MACHINES

This application claims priority from U.S. provisional application 60/127,917 filed Apr. 6, 1999.

BACKGROUND OF THE INVENTION

The present invention relates to an energy conservation system that is installed on an earth-moving loading machine having a boom assembly.

Wheel loaders and hydraulic excavators are typical earth-moving loading machines machines that are designed and constructed to dig, raise, and/or carry heavy payloads comprised of dirt, rocks, sand, other natural earth components, and/or construction materials. Such earth-moving loading machines commonly have a boom assembly that operably connects the base of the machine to a bucket or shovel. The boom assembly is raised and lowered by hydraulic cylinders which are controlled by a series of hydraulic valves. Energy is provided to the hydraulic cylinders by a diesel-powered or electric motor.

As mentioned, one common earth-moving loading machine is a hydraulic excavator. A hydraulic excavator has an open bucket mounted to the end of a boom assembly best described as an articulated arm having a boom portion and a stick portion. The hydraulic excavator is commonly used for digging materials from loading faces or shallow holes and trenches. A hydraulic excavator is one of the more versatile loading machines in that it can be configured as a front shovel or as a backhoe.

Another common earth-moving loading machine is a wheel loader. A wheel loader has a scoop-like bucket mounted to a boom assembly. This earth-moving loading machine is designed to lift and carry dirt, rocks, sand, and other construction materials. In practice, a wheel loader is commonly used to move materials from the ground, loading them into a truck, conveyor hopper, or storage bin.

In operation, an earth-moving loading machine cycles through a series of operations to dig, raise, and transfer a load. First, the operator of the loading machine lowers the bucket and then pushes and curls the bucket into a pile of fractured earth or material. The bucket is manipulated by the operator to obtain a full payload. Using the machine's hydraulic power, the boom hoist cylinders are filled, raising the boom assembly and bucket to the desired height, which typically is a height sufficient to clear the side rail of the truck being loaded. The operator then moves the bucket to the desired position (for example, adjacent a truck) and dumps the contents of the payload. The boom assembly is returned to a position for acquiring another payload. The operator opens the hydraulic control valves, allowing the hydraulic fluid to escape from the boom hoist cylinders, and causing the boom assembly and bucket to return to the lowered position under the force of their own weight. This cycle is then repeated.

For a fuller understanding of the hydraulic system of an earth-moving loading machine, see, for example, U.S. Pat. No. 5,855,159 issued to Yoshida and assigned to Komatsu, Ltd. of Japan; U.S. Pat. No. 5,471,808 issued to Lech and assigned to the Case Corporation of Racine, Wis.; and U.S. Pat. No. 5,103,253 issued to Kobayashi et al. and assigned to Kubota, Ltd. of Osaka, Japan. Each of these patents is incorporated herein by reference.

Clearly, the hydraulic forces required to raise the boom assembly are substantial. Hydraulic systems of the prior art, however, are extremely inefficient. Specifically, every time the machine dumps its payload from the raised position, the operator opens a hydraulic valve, releasing the hydraulic fluid and allowing it to flow back to the associated hydraulic tank, thereby lowering the boom assembly. In so doing, the potential energy stored through the raising of the boom assembly is lost.

It is therefore a paramount object of the present invention to provide a earth-moving loading machine that provides for more efficient raising and lowering of the boom assembly and bucket.

This and other objects and advantages of the present invention will become apparent upon a reading of the following description.

SUMMARY OF THE INVENTION

The energy conservation system of the present invention is preferably comprised of one or more pressurized gaseous pistons that extend from the front of the frame of an earth-moving loading machine to the boom assembly. Such a piston essentially acts as a spring that biases the boom assembly to a raised position. Thus, a portion of the weight of the boom assembly and associated payload is always supported by the piston. Alone, this piston does not provide sufficient force to maintain the boom assembly in a raised position. However, the use of such a piston reduces the forces that need to be supplied by the hydraulic boom hoist cylinders to raise the boom assembly. Thus, operating at the same cycle speeds as a prior art loading machine requires substantially less hydraulic horsepower. Or, if the same amount of hydraulic horsepower is provided. cycle times can be reduced and output increased because of the decreased time required to raise the boom assembly. The incorporation of the energy conservation system of the present invention into a loading machine also allows for a more controlled lowering of the boom assembly. Finally, the lowering of the boom assembly stores a portion of the potential energy by compressing the gaseous contents of the piston back to essentially the same pressure that existed prior to the raising of the boom assembly, thereby conserving energy.

DESCRIPTION OF THE PREFERRED EMBODIMENTS

The present invention relates to an energy conservation system that is installed on a hydraulic excavator, wheel loader, or similar earth-moving loading machine having a boom assembly. This energy conservation system decreases the hydraulic horsepower needed to raise and lower the boom assembly and payload, or, in the alternative, decreases the cycle time required to raise and lower the boom assembly.

Figure 1:
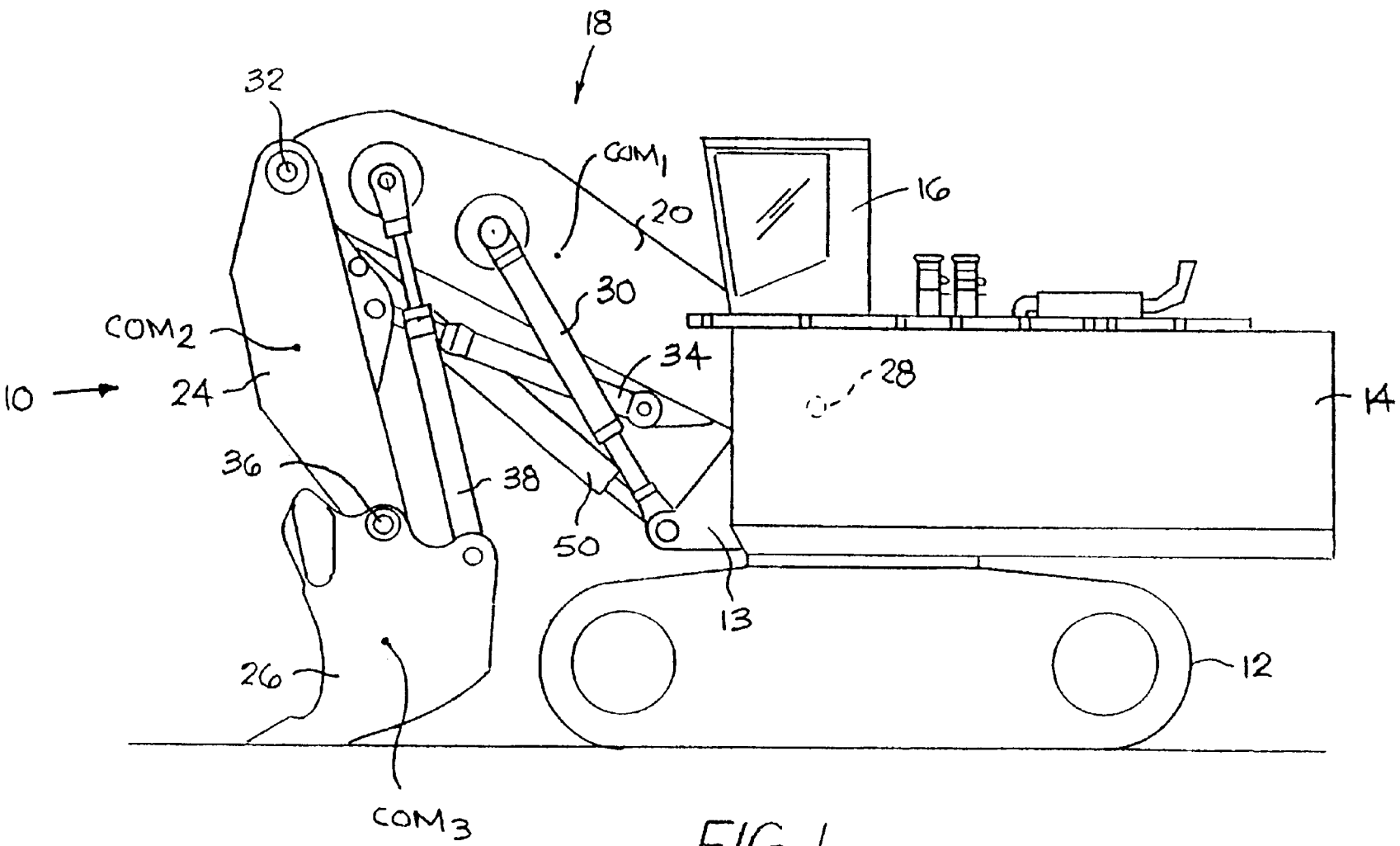
FIG. 1 is a side view of a front shovel, a specific type of hydraulic excavator, incorporating the energy conservation system of the present invention, the bucket of said front shovel in a lowered position.
Figure 1A:
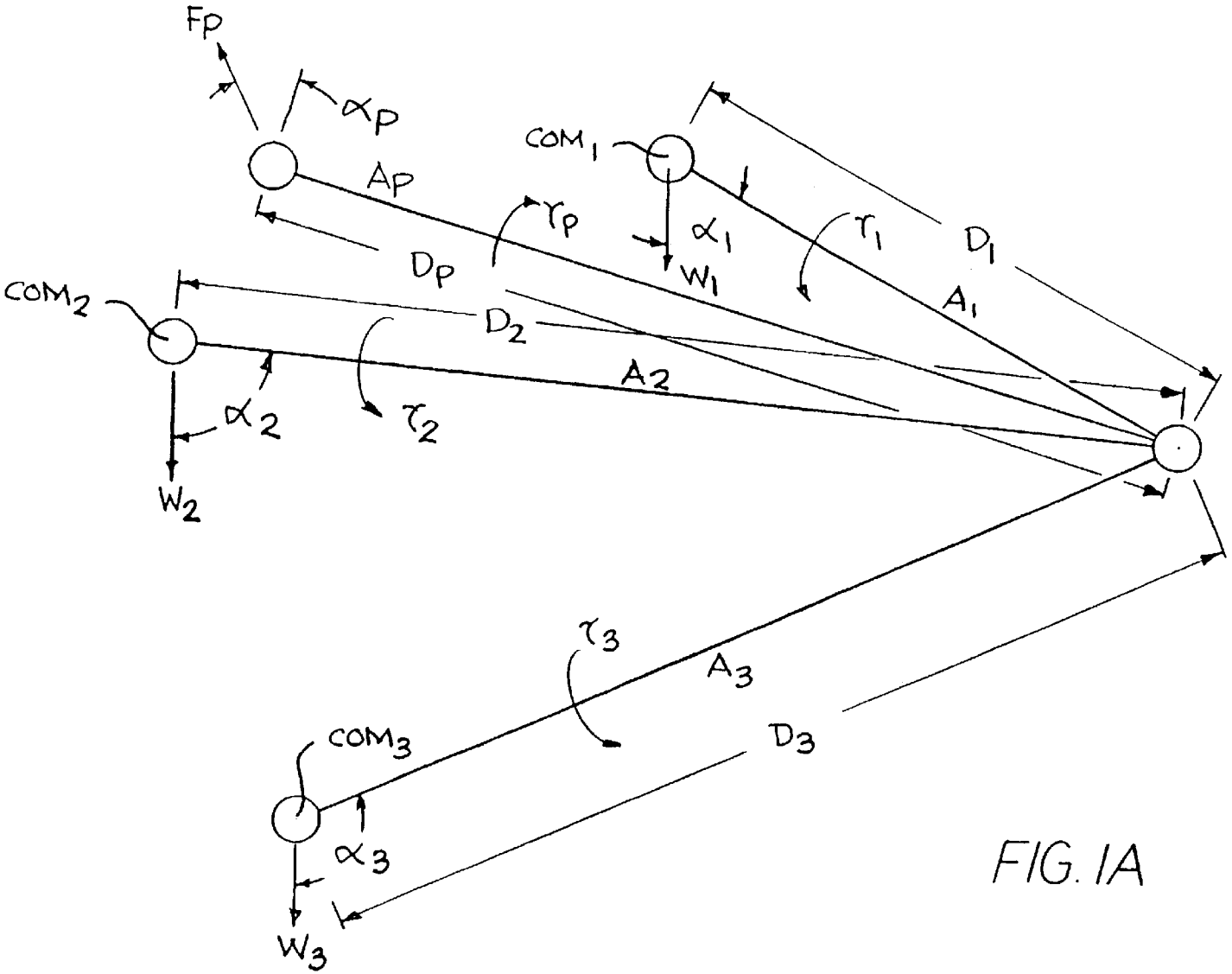
FIG. 1A is an enlarged schematic view of the forces and torques associated with the front shovel of FIG. 1.
Figure 2:
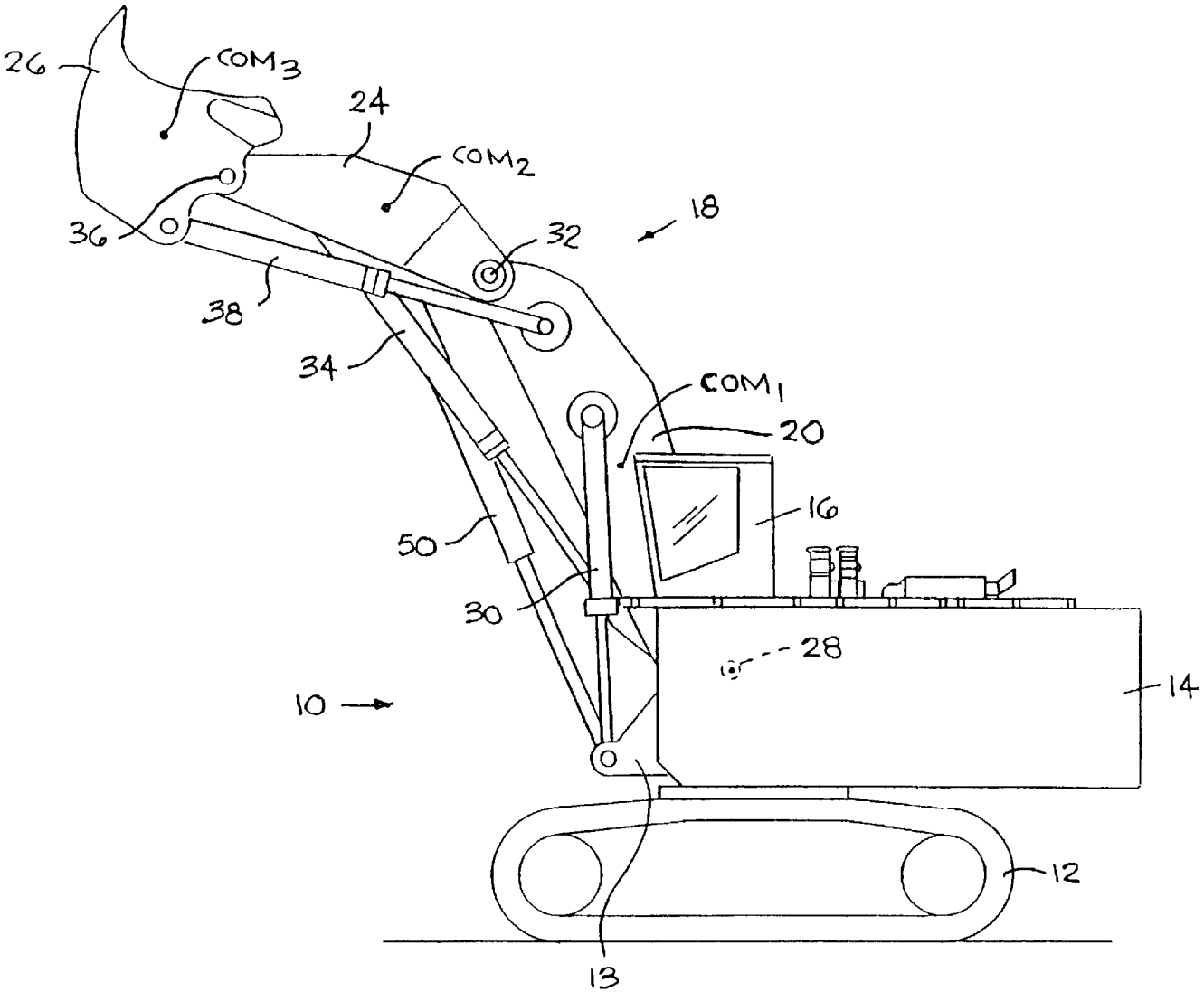
FIG. 2 is a side view of the front shovel of FIG. 1, the bucket of said front shovel in a raised position.

FIGS. 1, 1A, and 2 depict a front shovel 10, a specific type of hydraulic excavator, that incorporates an energy conservation system in accordance with the present invention. This front shovel 10 includes an undercarriage 12, a frame 13, an engine compartment 14, an operator cab 16, and a boom assembly 18. The undercarriage 12 provides the base support for the front shovel 10, and as depicted in FIGS. 1 and 2, preferably includes a crawler track system for mobility. The engine compartment 14 houses not only an engine but the hydraulic tank and associated pumps and equipment necessary to operate the boom assembly 18. The operator cab 16 houses all of the controls for operating the front shovel 10.

The frame 13 of the front shovel 10 is the primary support structure for the boom assembly 18, linking the boom assembly to 18 the undercarriage 12. The boom assembly 18 itself comprises a collection of interconnected components, namely: a boom 20 that is pivotably connected to the front of the frame 13; a stick 24 that is pivotably connected to the distal end of the boom 20; and a bucket 26 that is pivotably connected to the stick 24. Each of the pivot connections of the boom assembly 18 is preferably achieved through the use of a conventional lubricated steel pin.

Again, the boom 20 is pivotably connected to the frame 13, thereby allowing the boom to rotate about a pivot axis 28 relative to the frame 13. The rotation of the boom 20 relative to the frame 13 is controlled by left and right hydraulic boom hoist cylinders 30. At one end, this pair of cylinders 30 is pivotably connected to a front portion of the frame 13, and, at the opposite end, this pair of cylinders 30 is pivotably connected to the boom 20. Because of the position and orientation of these boom hoist cylinders 30, extension of the associated rods of the cylinders 30 causes a clockwise rotation of the boom 20 about pivot axis 28.

Similarly, the stick 24 is pivotably connected to the distal end of the boom 20 about a pivot axis 32. The rotation of the stick 24 relative to the boom 20 and about pivot axis 32 is controlled by left and right hydraulic stick cylinders 34. At one end, this pair of cylinders 34 is pivotably connected to the lower portion of the boom 20, and, at the opposite end, this pair of cylinders 34 is pivotably connected to the stick 24. Because of the position and orientation of these stick cylinders 34, extension of the associated rods of the cylinders 34 causes a clockwise rotation of the stick 24 about pivot axis 32.

Finally, the bucket 26 is pivotably connected to the distal end of the stick 24 about a pivot axis 36. The rotation of the bucket 26 relative to the stick 24 and about pivot axis 36 is controlled by left and right hydraulic bucket cylinders 38. At one end, this pair of cylinders 38 is pivotably connected to the boom 20, and, at the opposite end, this pair of cylinders 38 is pivotably connected to the bucket 26. Because of the position and orientation of these bucket cylinders 38, extension of the associated rods of the cylinders 38 causes a clockwise rotation of the bucket 26 about pivot axis 36.

Although not shown in the Figures, each of the above-described cylinders is in fluid communication with the hydraulic tank and associated pumps and equipment housed in the engine compartment 14. Again, for a fuller understanding of the hydraulic system of an earth-moving loading machine, see U.S. Pat. Nos. 5,855,159; 5,471,808; and 5,108,253, each of which is incorporated by reference.

Due to the weight of the individual components, this arrangement of the components of the boom assembly 18 creates a substantial counterclockwise torque about pivot axis 28, a torque that must be countered to raise the boom assembly 18, and a torque that the energy conservation system of the present invention seeks to offset. Such an offset decreases the work the various hydraulic cylinders must perform to manipulate the components of the boom assembly 18 and to raise the boom assembly 18 and associated payload.

The energy conservation system of the present invention is preferably comprised of one or more pressurized gaseous pistons 50 that extend from the front of the frame 13 of the front shovel 10 to the stick 24. In the preferred embodiment depicted in FIGS. 1, 1A, and 2, there is one such piston 50, which is pin connected to the front frame 13 at its rod end and is pin-connected to the stick 24 at its cylinder end. This piston 50 essentially acts as a spring that biases the boom assembly 18 to a raised position, the fully raised position of the front shovel 10 being shown in FIG. 2. Thus, a portion of the weight of the boom assembly 18 and associated payload is always supported by the piston 50. Alone, this piston 50 does not provide sufficient force to maintain the boom assembly 18 in a raised position. However, the use of such a piston 50 reduces the forces that need to be supplied by the hydraulic boom hoist cylinders 30 and hydraulic stick cylinders 34 to raise the boom assembly 18. Thus, operating at the same cycle speeds as a prior art front shovel requires substantially less hydraulic horsepower. Or, if the same amount of hydraulic horsepower is provided, cycle times can be reduced and output increased because of the decreased time required to raise the boom assembly 18.

The incorporation of the above-described piston 50 into the front shovel 10 also allows for a more controlled lowering of the boom assembly 18. Because a portion of the weight of the boom assembly 18 is always supported by the piston 50, the piston 50 prevents an uncontrolled, rapid descent of the boom assembly 18 should the operator allow the hydraulic fluid to escape from the hydraulic boom cylinders 30 and/or stick cylinders 34 too rapidly. The lowering of the boom assembly 18 further stores a portion of the potential energy by compressing the gaseous contents of the piston 50 back to essentially the same pressure that existed prior to the raising of the boom assembly 18, thereby conserving energy.

In selecting the appropriate piston 50 for incorporation into the front shovel 10 described above, it is important to carefully examine the forces and torques that act on the boom assembly 18. Again, the weight of each of the components of the boom assembly 18 creates a counterclockwise torque about pivot axis 28, the pin connection joining the boom 20 to the frame 13 of the front shovel 10. To calculate the torque generated by each component, the center of mass for each component must be defined along with the distance said center of mass is located from the pivot axis 28. As best shown in FIG. 1A, the boom 20 has a weight $W_1$ that acts at a center of mass $COM_1$ that is located a distance $D_1$ from the pivot axis 28. The stick 24 has a weight $W_2$ that acts at a center of mass $COM_2$ that is located a distance $D_2$ from the pivot axis 28. And, the bucket 26 and associated payload has a weight $W_3$ that acts at a center of mass $COM_3$ that is located a distance $D_3$ from the pivot axis 28.

Next, an axis $A_1$ is defined as a line extending between $COM_1$ and pivot axis 28. Similarly, a second axis $A_2$ is defined as a line extending between $COM_2$ and pivot axis 28, and a third axis $A_3$ is defined as a line extending between $COM_3$ and pivot axis 28.

The torque about pivot axis 28 generated by the weight of the boom 20 is a product of $D_1$ and the weight of the boom 20 acting in a vector perpendicular to $A_1$, or $$\zeta_1=D_1\times W_1\times\sin\alpha_1$$

where $\alpha_1$ is the angle between $A_1$ and a vertical axis, as shown in FIG. 1A.

The torque about pivot axis 28 generated by the weight of the stick 24 is a product of $D_2$ and the weight of the stick 24 acting in a vector perpendicular to $A_2$, or $$\zeta_2=D_2\times\sin\alpha_2$$

where $\alpha_2$ is the angle between $A_2$ and a vertical axis.

Finally, the torque about pivot axis 28 generated by the weight of the bucket 26 and associated payload is a product of $D_3$ and the weight of the bucket 26 and associated payload acting in a vector perpendicular to $A_3$, or $$\zeta_3=D_3\times W_3\times\sin\alpha_3$$

where $\alpha_3$ is the angle between $A_3$ and a vertical axis.

The sum of these torque values $\zeta_1$, $\zeta_2$, $\zeta_3$ is the total torque or moment created by the weight of the boom assembly 18 about pivot axis 28:

$$\zeta_W=\zeta_1+\zeta_2+\zeta_3$$

Depending on the relative orientation of the various components of the boom assembly 18, this total torque (will differ, the maximum torque resulting when the axes $A_1$, $A_2$, and $A_3$ are oriented substantially horizontally.

The energy conservation system of the present invention seeks to offset $\zeta_W$, thereby countering the weight of the boom assembly 18. This is achieved through a clockwise torque applied to the stick 24 by the piston 50 described above. As shown in FIG. 1A, this piston 50 applies a force $F_P$ along an axis $A_P$ at a distance $D_P$ from the pivot axis 28. The resultant clockwise torque generated by the force $F_P$ is a product of $D_P$ and the piston force acting in a vector perpendicular to $A_P$, or $$\zeta_P=D_P\times F_P\times\cos\alpha_P$$

If at any point in the travel of the boom assembly 18 from a lowered position to a raised position, $\zeta_P=\zeta_W$, the piston 50 will completely offset the torque generated by the weight of the boom assembly 18 and associated payload.

Selection of the appropriate piston 50 requires a consideration of the offset ratio desired, the offset ratio $\eta$ being defined as:

$$\eta=\zeta_P/\zeta_W$$

A high offset ratio $\eta$ would be in the range of 0.75–1.00, complete offset being achieved when $\eta$=1.00. A moderate offset ratio $\eta$ would be in the range of 0.5–0.75.

Again, it is important to note that the values of $\zeta_P$ and $\zeta_W$ vary as the boom assembly 18 and its various components travel through their respective ranges of motion. Therefore, the offset ratio $\eta$ will fluctuate to some extent. Nevertheless, by selecting a desired offset ratio $\eta_{DESIRED}$ (perhaps based on the fully raised position of the boom assembly 18 as shown in FIG. 2), the appropriate piston 50 can be selected and sized:

$$\zeta_P=\zeta_W\times\eta_{DESIRED}=D_P\times F_P\times\cos\alpha_P$$

As the above equation makes clear, after determining the value of $\zeta_W$ and selecting $\eta_{DESIRED}$, it is possible to solve for $F_P$ for a given position of the boom assembly 18:

$$F_P=(\zeta_W\times\eta_{DESIRED})/(D_P\times\cos\alpha_P)$$

This force $F_P$ is a function of the diameter of the cylinder rod and the gaseous pressure in the piston 50. Thus, it is preferred that the piston 50 be selected by first choosing a piston with the largest available rod diameter that will not physically interfere with the operation of the boom assembly 18. At the same time, the preferred piston must have sufficient extension and retraction range so as not to limit the range of motion of the boom assembly 18. Finally, for optimal performance, it is preferred that the selected piston has a very large rod diameter to cylinder barrel diameter ratio.

In accordance with the above requirements, it is preferred that a nitrogen-charged piston be used in the energy conservation system of the present invention. To maintain an appropriate volume of nitrogen gas in the piston 50, one or more nitrogen containers or bottle are connected to the piston 50 by a high pressure hydraulic hose (not shown). The nitrogen container supplies nitrogen to the piston 50, thereby reducing the variation and fluctuation of gaseous pressure in the piston 50 due to the extension and retraction of the piston 50.

To further explain the function and result of incorporating the energy conservation system of the present invention into the front shovel 10 shown in FIGS. 1, 1A, and 2, assume that the preferred nitrogen-charged piston 50 has a rod diameter of 12 inches and maintains a pressure of 3000 pounds per square inch. Such a nitrogen-charged piston 50 will generate nearly 340,000 pounds of force:

$$F_P=[(\text{Diameter})/2]^2\times\pi\times\text{Gaseous Pressure}$$

$$F_P=[(12\text{ inches})/2]^2\times\pi\times(3000\text{ pounds per square inch})$$

$$F_P=339{,}292\text{ pounds}$$

If such a force was applied to the boom assembly 18 in its raised position, as shown in FIG. 2, more than 1.3 million foot-pounds of clockwise torque would be generated about pivot axis 28:

$$\zeta_P=D_P\times F_P\times\cos\alpha_P$$

$$\zeta_P=(20.5\text{ feet})\times(339{,}292\text{ pounds})\times\cos(79°)$$

$$\zeta_P=1{,}327{,}169\text{ foot-pounds}$$

Assume now that the weights of the components of the boom assembly (i.e., the boom 20, the stick 24, and the bucket 26) are known, as are the distances from the pivot axis 28 to the respective centers of mass of the components when the boom assembly 18 is in a raised position:

$W_1$=50,000 pounds
$W_2$=26,000 pounds
$W_3$=64,000 pounds
$D_1$=12 feet
$D_2$=24 feet
$D_3$=31 feet Using the equations set forth above, the torques associated with the boom 20, the stick 24, and the bucket 26 can be calculated as follows:

$$\zeta_1=D_1\times W_1\times\sin\alpha_1$$

$$\zeta_1=(12\text{ feet})\times(50{,}000\text{ pounds})\times\sin(2°)$$

$$\zeta_1=20{,}939\text{ foot-pounds}$$

$$\zeta_2=D_2\times W_2\times\sin\alpha_2$$

$$\zeta_2=(24\text{ feet})\times 26{,}000\text{ pounds}\times\sin(18^\circ)$$

$$\zeta_2=192{,}826\text{ foot-pounds}$$

$$\zeta_3=D_3\times W_3\times\sin\alpha_3$$

$$\zeta_3=(31\text{ feet})\times(64{,}000\text{ pounds})\times\sin(39^\circ)$$

$$\zeta_3=1{,}248{,}571\text{ foot-pounds}$$

The sum of these torque values $\zeta_1$, $\zeta_2$, $\zeta_3$ is the total torque or moment created by the weight of the boom assembly 18 about pivot axis 28:

$$\zeta_W=\zeta_1+\zeta_2+\zeta_3$$

$$\zeta_W=(20{,}939+192{,}826+1{,}248{,}571)\text{ foot-pounds}$$

$$\zeta_W=1{,}462{,}336\text{ foot-pounds}$$

Again, the offset ratio $\eta$ is defined as:

Therefore, when the boom assembly 18 is in a raised position, the offset ratio would be:

$$\eta=(1{,}327{,}169\text{ foot-pounds})/(1{,}462{,}336\text{ foot-pounds})$$

$$\eta=0.907$$

Such an offset of the torque generated by the boom assembly 18 and associated payload would clearly result in substantially less work being required of the hydraulic boom hoist cylinders 30 and hydraulic stick cylinders 34 to raise the boom assembly 18 and associated payload. Thus, operating at the same cycle speeds as a prior art front shovel requires substantially less hydraulic horsepower. Or, if the same amount of hydraulic horsepower is provided, cycle times can be reduced and output increased because of the decreased time required to raise the boom assembly 18 and associated payload. Also, as mentioned above, this system allows for a more controlled lowering of the boom assembly 18. Finally, as the boom assembly 18 is lowered, potential energy is stored through compression of the gaseous contents of the piston 50, thereby conserving energy.

Figure 3:
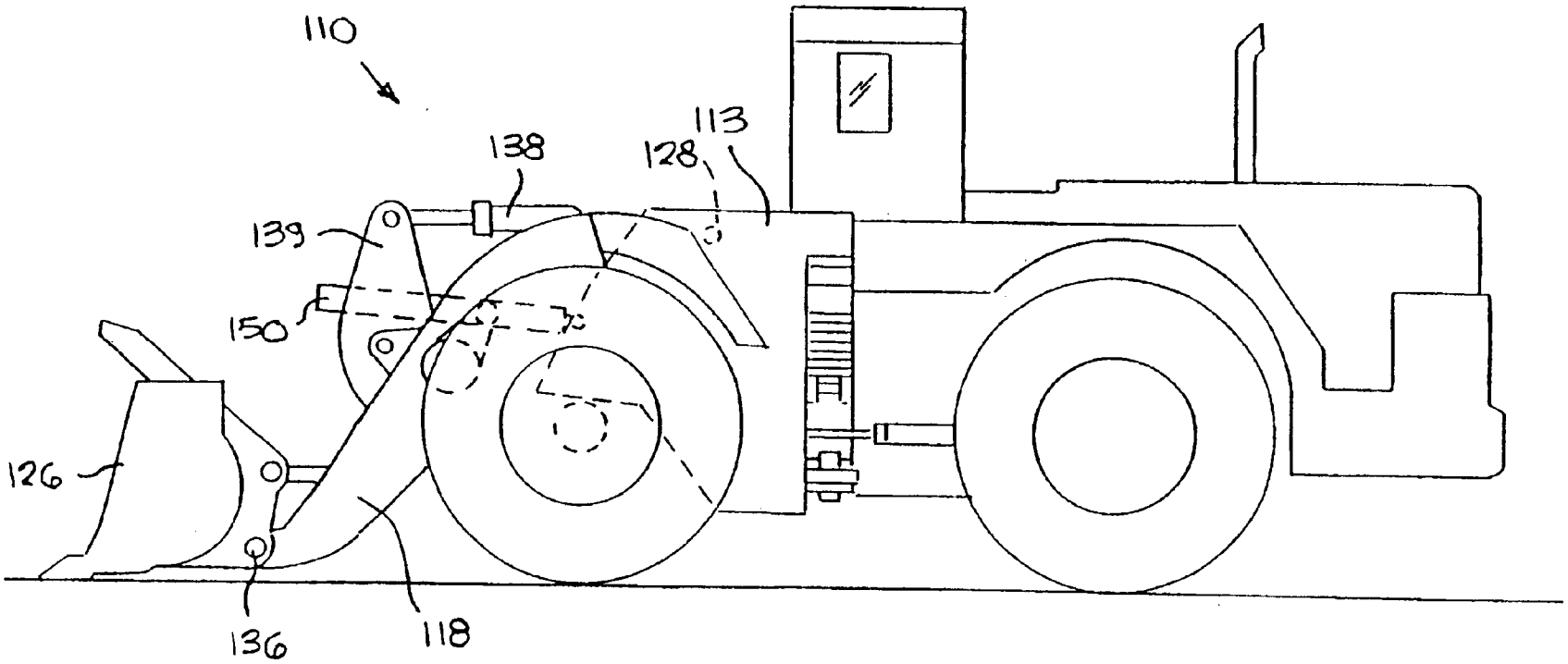
FIG. 3 is a side view of a wheel loader incorporating the energy conservation system of the present invention, the bucket of said wheel loader in a lowered position.
Figure 4:
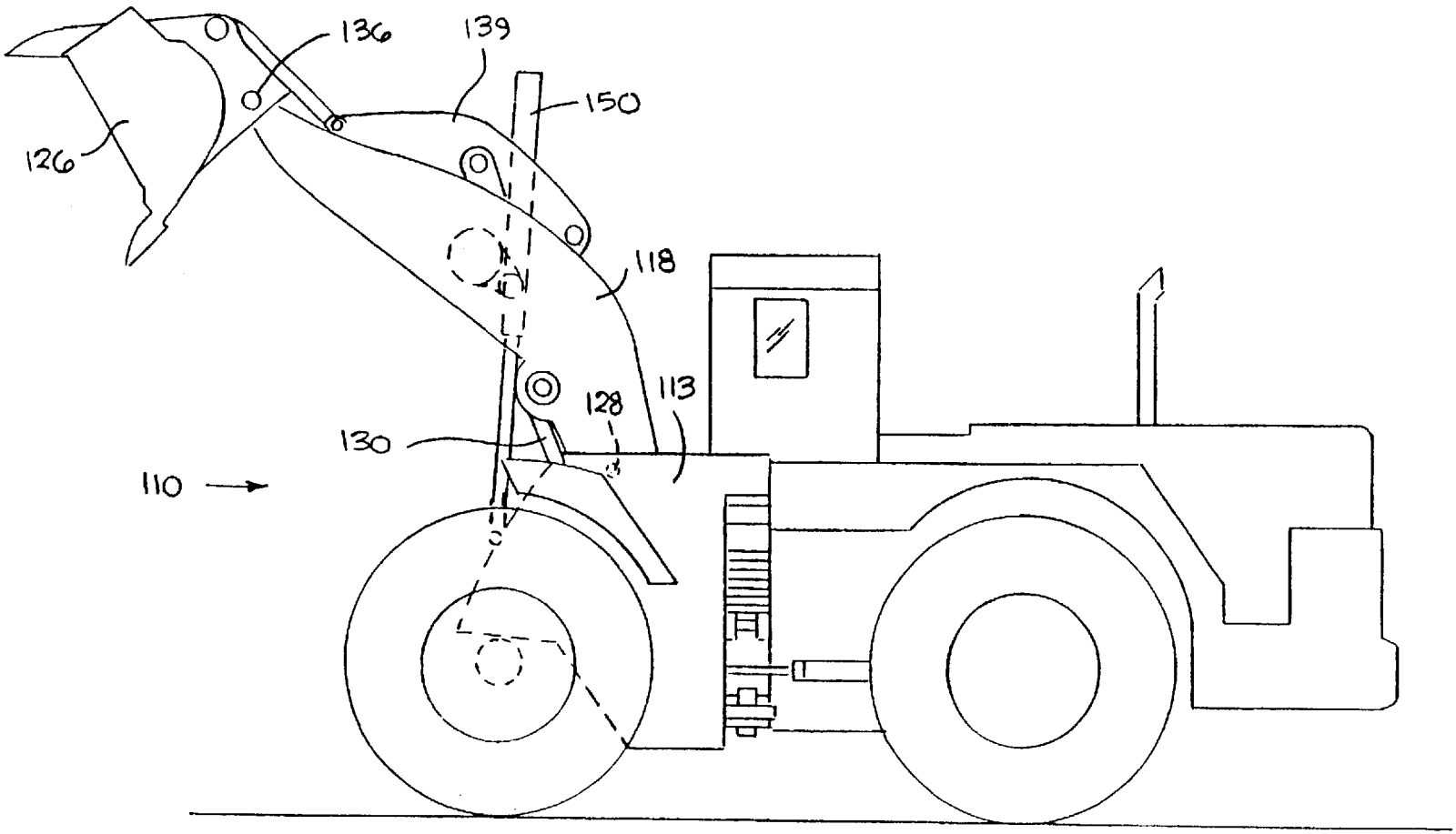
FIG. 4 is a side view of the wheel loader of FIG. 3, the bucket of said wheel loader in a raised position.

FIGS. 3 and 4 depict a wheel loader 110 incorporating the energy conservation system of the present invention. This system functions in much the same manner as the system installed on the front shovel 10 shown in FIGS. 1 and 2. Unlike the front shovel, however, the wheel loader 110 has a single boom arm 118. This boom arm 118 is pivotably secured to the frame 113 of the wheel loader 110 about a pivot axis 128. A bucket 126 is pivotably secured to the opposite end of the boom arm 118, allowing the bucket 126 to pivot about pivot axis 136. Similar to the front shovel, the boom arm 118 is raised and lowered by left and right boom hoist cylinders 130, as shown in FIG. 4. A second pair of hydraulic cylinders 138 (shown in FIG. 3) is used to control the bell-crank linkage 139, which in turn controls pivoting of the bucket 126.

As discussed with reference to the front shovel, a substantial counterclockwise torque is generated about pivot axis 128, a torque that the energy conservation system of the present invention seeks to offset. In this case, a single pressurized gaseous piston 150 is pivotably mounted to and extends from the front of the frame 113 of the wheel loader 110. To provide for a sufficient range of extension and retraction of the piston 150, the piston 150 is not secured to the boom arm 118 at the distal end of the piston 150; rather, the piston 150 is pivotably secured to the boom arm 118 at an appropriate location along the lateral surface of the piston 150. As discussed above with reference to the front shovel 10, this piston 150 essentially acts as a spring that biases the boom arm 118 to a raised position. Thus, a portion of the weight of the boom arm 118 and associated payload is always supported by the piston 150.

Aside from the above-described front shovel and wheel loader. other earth-moving loading machines, such as a backhoe or other hydraulic excavator, could also be equipped with the energy conservation system of the present invention.

It will be obvious to those skilled in the art that modifications may be made to the preferred embodiments described herein without departing from the spirit and scope of the present invention.

I claim:

1. A loading machine for raising and transporting a payload, comprising:

a base structure providing underlying support to said loading machine;

a frame secured to said base structure;

a boom assembly pivotably connected to said frame for rotating about a first substantially horizontal pivot axis between a raised position and a lowered postition, said boom assembly including a bucket for carrying a payload, the weight of said boom assembly and said payload generating a torque about said first substantially horizontal pivot axis in a first direction;

one or more hydraulic boom hoist cylinders for raising and lowering said boom assembly between said raised and lowered positions, rotating said boom assembly about said first substantially horizontal pivot axis; and an energy conservation piston pivotably secured at a first end to said frame and pivotably secured at a second location to the boom assembly, said energy conservation piston having an energy-storing portion when said boom assembly is in the lowered position and providing an axial force that generates a torque about said first substantially horizontal pivot axis in a second direction, thereby offsetting the torque generated by the weight of said boom assembly and said payload acting in said first direction.

2. A loading machine as recited in claim 1, wherein said energy conservation piston is a pressurized gaseous piston.

3. A loading machine as recited in claim 2, wherein said energy conservation piston is a nitrogen-charged gaseous piston, said piston being in fluid communication with a container storing nitrogen gas.

4. A loading machine as recited in claim 1, said boom assembly comprising:

a boom pivotably connected to said frame at a first end for rotating about said first substantially horizontal pivot axis; and a stick pivotably connected to a second end of said boom for rotating about a second substantially horizontal pivot axis, and defining a distal end;

wherein said bucket is pivotably connected to the distal end of said stick for rotating about a third substantially horizontal pivot axis; and wherein said energy conservation piston is pivotably secured at its second end to the stick of said boom assembly.

5. A loading machine as recited in claim 4, wherein first and second boom hoist cylinders are pivotably connected to a front portion of said frame at a first end and are pivotably connected to the boom at a second end.

6. A loading machine as recited in claim 5, and further comprising left and right hydraulic stick cylinders pivotably connected to a lower portion of said boom at one end and pivotably connected to said stick at a second end, said left and right hydraulic stick cylinders controlling the rotation of said stick relative to the boom and about said second substantially horizontal pivot axis.

7. A loading machine as recited in claim 6, and further comprising left and right hydraulic bucket cylinders pivotably connected to said boom at one end and pivotably connected to said bucket at a second end, said left and right hydraulic bucket cylinders controlling the rotation of said bucket relative to the stick and about said third substantially horizontal pivot axis.

8. A loading machine as recited in claim 1, said boom assembly comprising a boom arm pivotably connected to said frame at a first end for rotating about said first substantially horizontal pivot axis, and defining a distal end;

wherein said bucket is pivotably connected to the distal end of said boom arm for rotating about a second substantially horizontal pivot axis; and wherein said energy conservation piston is pivotably connected to the boom arm of said boom assembly.

9. A loading machine as recited in claim 8, wherein first and second boom hoist cylinders are pivotably connected to a front portion of said frame at a first end and are pivotably connected to the boom arm at a second end.

10. A loading machine for raising and transporting a payload, comprising:

a base structure providing underlying support to said loading machine;

a frame secured to said base structure;

a boom assembly pivotably connected to said frame for rotating about a first substantially horizontal pivot axis between a raised position and a lowered position, said boom assembly including a bucket for carrying a payload, the weight of said boom assembly and said payload generating a torque about said first substantially horizontal pivot axis in a first direction;

one or more hydraulic boom hoist cylinders for raising and lowering said boom assembly between said raised and lowered positions, rotating said boom assembly about said first substantially horizontal pivot axis; and an energy storing piston responsive to said boom assembly being lowered, storing a portion of the potential energy possessed by said boom assembly in the raised position, said piston when storing energy urging said boom assembly to rotate about said first substantially horizontal pivot axis toward said raised position.

11. A loading machine as recited in claim 10, wherein said energy conservation piston is a pressurized gaseous piston.

12. A loading machine as recited in claim 11, wherein said energy conservation piston is a nitrogen-charged gaseous piston, said piston being in fluid communication with a container storing nitrogen gas.

13. A loading machine as recited in claim 10, said boom assembly comprising:

a boom pivotably connected to said frame at a first end for rotating about said first substantially horizontal pivot axis; and a stick pivotably connected to a second end of said boom for rotating about a second substantially horizontal pivot axis, and defining a distal end;

wherein said bucket is pivotably connected to the distal end of said stick for rotating about a third substantially horizontal pivot axis; and wherein said energy conservation piston is pivotably secured at its second end to the stick of said boom assembly.

14. A loading machine as recited in claim 13, wherein first and second boom hoist cylinders are pivotably connected to a front portion of said frame at a first end and are pivotably connected to the boom at a second end.

15. A loading machine as recited in claim 14, and further comprising left and right hydraulic stick cylinders pivotably connected to a lower portion of said boom at one end and pivotably connected to said stick at a second end, said left and right hydraulic stick cylinders controlling the rotation of said stick relative to the boom and about said second substantially horizontal pivot axis.

16. A loading machine as recited in claim 15, and further comprising left and right hydraulic bucket cylinders pivotably connected to said boom at one end and pivotably connected to said bucket at a second end, said left and right hydraulic bucket cylinders controlling the rotation of said bucket relative to the stick and about said third substantially horizontal pivot axis.

17. A loading machine as recited in claim 10, said boom assembly further comprising a boom arm pivotably connected to said frame at a first end for rotating about said first substantially horizontal pivot axis, and defining a distal end;

wherein said bucket is pivotably connected to the distal end of said boom arm for rotating about a second substantially horizontal pivot axis; and wherein said energy conservation piston is pivotably secured to the boom arm of said boom assembly.

18. A loading machine as recited in claim 17, wherein first and second boom hoist cylinders are pivotably connected to a front portion of said frame at a first end and are pivotably connected to the boom arm at a second end.

* * * * *